US009089850B2

(12) United States Patent
Hudson et al.

(10) Patent No.: US 9,089,850 B2
(45) Date of Patent: Jul. 28, 2015

(54) METHOD AND APPARATUS FOR SEPARATION OF PHARMACEUTICAL MATERIALS ON THE BASIS OF THEIR DENSITY

(75) Inventors: Bruce S. Hudson, Syracuse, NY (US); Jack Melton, Fayetteville, NY (US)

(73) Assignee: Syracuse University, Syracuse, NY (US)

( * ) Notice: Subject to any disclaimer, the term of this patent is extended or adjusted under 35 U.S.C. 154(b) by 586 days.

(21) Appl. No.: 12/765,937

(22) Filed: Apr. 23, 2010

(65) Prior Publication Data

US 2011/0068064 A1 Mar. 24, 2011

Related U.S. Application Data

(60) Provisional application No. 61/244,568, filed on Sep. 22, 2009.

(51) Int. Cl.
*B03B 5/00* (2006.01)
*B03D 3/00* (2006.01)

(52) U.S. Cl.
CPC ..... *B03D 3/00* (2013.01)

(58) Field of Classification Search
USPC ..... 209/162–172.5; 210/513, 800
See application file for complete search history.

(56) References Cited

U.S. PATENT DOCUMENTS

| | | | | |
|---|---|---|---|---|
| 6,709,871 | B2 * | 3/2004 | Anderson | 436/174 |
| 6,965,832 | B2 * | 11/2005 | Kobylecki et al. | 702/27 |
| 2007/0264349 | A1 * | 11/2007 | Lee et al. | 424/489 |

OTHER PUBLICATIONS

Rohani S. Polymorphism and crystallization of active pharmaceutical ingredients (APIs), Abstract 2009 [Retrieved from the Internet Dec. 16, 2013] <URL: >http://www.ncbi.nlm.nih.gov/pubmed/19275600<>.*

* cited by examiner

*Primary Examiner* — Joseph C Rodriguez
*Assistant Examiner* — Kalyanavenkateshware Kumar
(74) *Attorney, Agent, or Firm* — Frederick J. M. Price; Bond Schoeneck & King, PLLC

(57) ABSTRACT

Systems and methods for separating particles of pharmaceutically active materials, based on differences in density.

9 Claims, 6 Drawing Sheets

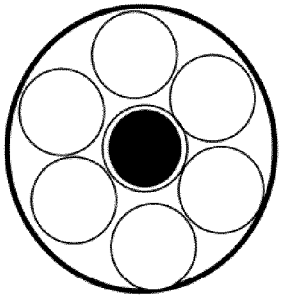
FIG. 3A
FIG. 3B
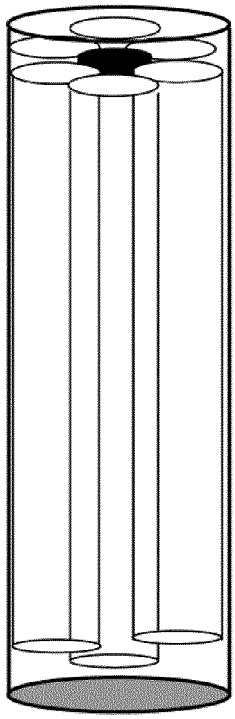

METHOD AND APPARATUS FOR SEPARATION OF PHARMACEUTICAL MATERIALS ON THE BASIS OF THEIR DENSITY

CROSS-REFERENCE TO RELATED APPLICATIONS

This application claims priority to and the benefit of U.S. provisional patent application Ser. No. 61/244,568, filed Sep. 22, 2009 which application is incorporated herein by reference in its entirety.

FIELD OF THE INVENTION

The invention relates to pharmaceutical process science in general and particularly to a method of separation of the solid components of a pharmaceutical ingredient in a preparation of pharmaceutical materials in solid form on the basis of the density of each component.

BACKGROUND OF THE INVENTION

Pharmaceuticals are often formulated from crystalline compounds because crystalline materials often provide high levels of purity and are resistant to chemical instability under ambient conditions. Crystalline materials of a single chemical species with a common molecular structure may exist in more than one polymorphic form. Polymorphic forms are differing packing arrangements of the same molecular species, i.e., the same chemical substance at the molecular level. Polymorphs differ only at the level of the crystalline solid. The translational repeating unit in the structure of a crystal is the unit cell. Two polymorphic forms may have crystallographic unit cells that differ in number of molecules in the unit cell and in volume or and, most importantly to us, in the value of the volume per molecule. Two polymorphic forms of the same chemical substance can differ in density.

U.S. Pat. No. 6,965,832 "Investigating different physical and/or chemical forms of materials" describes formation of distinguishable crystals but it does not involve their physical separation. This patent also includes a detailed description of the current state of the art.

U.S. Pat. No. 6,965,832 claims (see claim 1, column 14, line 14) that the invention is comprised of "providing an array of receptacles each containing material (hereinafter 'said initial material") to be investigated; subjecting said initial material in respective different receptacles to respective different treatments under the control of a computer; and analyzing any material resulting from said different treatments (hereinafter 'said resultant material')" (underline added). All subsequent claims refer to claim 1 either directly or indirectly. The methods of treatment enumerated are variations in solvent, other chemical additives especially salt forming materials, pressure to retain solvent or time of treatment, temperature, heating or cooling and cycles of same. The need for distinct treatments is inherent to this method due to lack of physical separation.

U.S. Pat. No. 6,709,871, "Precision Fluid Gradient Formation" provides a detailed and in-depth review of the state of the art and the history of the technology of formation of liquid density gradients. The terms "polymorph" and "crystal" do not appear in this patent.

U.S. Pat. No. 6,709,871 refers only to separation of cells. "Pharmaceutical" is mentioned only in respect to the use of cells separated by this method in testing of said pharmaceuticals. The method and the device used in U.S. Pat. No. 6,709,871 is designed for use with aqueous solvents and for relatively low densities appropriate to the separation involved.

There is a need for systems and methods that will unambiguously permit the enumeration and characterization of polymorphic forms present in a sample of crystallized active pharmaceutical ingredient or, more generally, in a pharmaceutical preparation containing the active pharmaceutical ingredient.

SUMMARY OF THE INVENTION

Statement of the Problem

Polymorphism, the occurrence of multiple polymorphic forms, is an important problem for the pharmaceutical industry. [Hilfiker, 2006; FDA, 2004] Polymorphic crystal forms result in exactly the same substance when the crystalline species is dissolved in a liquid. However, the equilibrium concentration of a saturated solution in the presence of the crystalline form of a material depends on the polymorphic form of that material. The more thermodynamically stable polymorphic form is necessarily the least soluble. Further, the rate at which polymorphic forms dissolve may differ greatly. This influences absorption by the body and thus bioavailability.

The ingredient that is of pharmaceutical importance in a pharmaceutical preparation or formulation will be referred to as the active pharmaceutical ingredient or API. This refers to the chemical substance independent of polymorphic form, solvate, hydrate or salt. Other ingredients may be present in a pharmaceutical preparation.

Haleblian and McCrone have reviewed (Haleblian & McCrone, 1969) the history of the importance of polymorphism as it relates specifically to pharmaceutical materials. In this work they cite the work in Austria of Brandstätter (later Kuhnert-Brandstätter) which begins with the 1942 studies of barbiturates and later studies of polymorphism of steroids and antihistamines. The problem of the polymorphic forms of pharmaceutical materials has thus been appreciated for almost 70 years. A recent popular summary of the pervasive nature of this problem is given in a wide distribution American Chemical Society newsletter (Rouhi, 2003).

Because distinct polymorphic forms have differing bioavailability, the polymorphic form present in a dosage of a pharmaceutical must be controlled and specified at the time that the effective and safe dose is established in tests. Approval for use is limited to the specified polymorphic state used in the tests. For this reason it is necessary to establish the polymorphic state of the API in the preparation in the final dosage form. This requires demonstration of the polymorphic form in the early stages of preparation of each batch of the material and at each stage throughout the subsequent process of formulation. The reasons for this are briefly outlined below.

Since the most stable polymorphic form is the least soluble, continued presence of a solvent will, in principle, ultimately result in the least soluble form. One mechanism by which this conversion occurs is that some seed crystal of each of a more stable and less soluble form occurs. The seed of the more stable form nucleates growth of that form at the expense of the less stable form which re-dissolves and feeds the growth of the more stable form. As a result the less stable form disappears. This is a thermodynamic argument and is thus always correct if one could wait an indeterminately long time, but is not always observed in practice. All carbon is not graphite The formation of new polymorphic forms in late stage development and scale-up is so common (Karpinski, 2006 gives over 20 examples), and the fact that this may be a very expensive event, has led to a general view in the industry that the most stable polymorphic form is the one that should be recommended for development. There are several difficulties with this statement as made and as a general policy. One is that one never really knows when the most stable form has been found. The most stable form is (almost by definition) the last one to be found unless solid transformations are facile. Another issue is that polymorphic forms that are not the most stable may have a variety of properties that are advantageous with respect to other more stable forms, such as, for example, higher chemical purity, higher rate of dissolution, higher solubility, or better processability. The use of the less stable form may be justified if a process can be found that produces it reliably and if it can be shown that the material remains "indefinitely" in the metastable form. This becomes more of an issue if the most stable form is not usable at all and the API is the only known method for treatment of some serious condition. In that case the time-scale "indefinitely" becomes the 10-20 years that it takes for a replacement API to be found. The choice of the most stable form is the easy way out for risk-averse organizations; it is not necessarily the best solution from the public health perspective. Production and marketing of materials with a finite shelf life or storage conditions is also a possibility.

There are cases where polymorph conversion occurs in the solid state over the course of 3 weeks (Karpinski, 2006, 3.1 "Creeping Polymorphic Transformation"). In the normal course of events this would have occurred after formulation and packaging and, perhaps, distribution.

The case of ritonavir (Novir™ Abbott Laboratories) (Knapman, 2000; Bauer, 2001) is perhaps the best known example of polymorphic conversion that was discovered after distribution of the final product. Ritonavir is an HIV protease inhibitor. Novir™ was commercialized in 1996 and withdrawn in 1998. It is a gel capsule formulation. Bauer et al, 2001 (of Abbott Laboratories) state: "Ritonavir was found to exhibit conformational polymorphism with the "cis" and "trans" conformations around the carbamate linkage leading to two unique crystal lattices with significantly different solubility properties. Although the polymorph (form II) corresponding to the "cis" conformation is a more stable packing arrangement, nucleation of the polymorph requires the formation of a less stable conformation in solution, clustering of this less stable conformation and subsequent crystal growth. This nucleation process, even in the presence of form II seeds, is energetically unfavored except in highly supersaturated solutions. For this reason form II may never have been identified except for the coincidence of a solution which was very highly supersaturated (~400%) with respect to the polymorph and an unknown nucleation enhancer, possibly a related compound capable of heterogeneously seeding the solution." There are now at least three other polymorphic forms of ritanovir known in addition to the initial two forms. The point to be made from this quotation is that it is quite likely that in this case—and possibly in many other cases—the form I to form II transformation would not have taken place if the formulation had been a solid preparation. Form I might have been "indefinitely" stable and thus usable in formulations.

These considerations and historical events make it clear that a method for the evaluation of polymorphic content after formulation is needed for the industry and for safety of the pharmaceutical supply chain.

The polymorphic form that is obtained in a crystallization process depends on numerous factors. Some of these are the time duration and temperature of that process, often on what solvent is used, and on the degree of super-saturation.

A new polymorphic form often occurs unexpectedly and often at the final crystallization step of large scale production. [Hegedüs & Görög, 1985; Chemburkar et al., 2000; Karpinski, 2006] When this happens, there is a problem. Crystallization is usually the last solution stage in the production process of a pharmaceutical and is also usually the last and primary purification process. The lack of predictability of the occurrence of a polymorphic form that has not previously been observed under the conditions of solvent, time, temperature and degree of super-saturation used in production, means that good process control and monitoring is needed.

The definitive "gold standard" characterization of a polymorphic form is its single crystal x-ray diffraction structure. An x-ray diffraction structure establishes the number of molecules per unit cell and the unit cell volume. From this the density is easily computed. The polymorphic form of a material can be changed by grinding so preparation of a polycrystalline sample that is polymorphically pure by grinding a single crystal is problematic. [Cheng & Lin, 2008; Lin, 2007; Descamps et al., 2007; Doelker, 2002; Picker-Freyer et al., 2007] Further, the observation of a particular polymorphic form found for a single crystal chosen from a sample that is the result of a crystallization does not mean that all of that sample has that form.

Some polymorphic phase transitions depend on the presence of very small amounts of other components such as moisture. [Cheng, 2008] This is hard to control, especially in large scale preparation.

The presence of a particulate component in a reaction vessel, which may be a seed crystal of a polymorphic form of an API, can lead to results not previously seen.

Besides these situations involving distinct polymorphic forms, there are, in practice, also cases where the crystals that form are solvates that include solvent molecules in what are often referred to as co-crystals, or the product may be a salt or it may be amorphous, i.e., a non-diffracting solid material. Although these are not strictly polymorphic forms they are often so referred to in pharmaceutical process science. In this application all such forms are encompassed as the API. Further, the definition of API includes its defined molecular composition as active pharmaceutical ingredient in any of its solid forms.

When an API is crystallized it is not immediately known what polymorphic form or forms are present in the preparation. The nature of this mixture may change at subsequent steps in the process. The usual methods for establishment of the nature of the mixture of polymorphic forms in a preparation are powder x-ray diffraction (XRPD), differential scanning calorimetry (DSC), Raman spectroscopy and CP-MAS solid state NMR. [Hilfiker, et al., 2006] These methods provide signals from all components of the preparation. The information as to the presence of minor polymorphic forms requires knowledge of a spectral or diffraction signal characteristic of that species.

These methods of analysis of mixtures of polymorphic forms depend ultimately on having authentic samples of all polymorphic forms that can be used to determine signals characteristic of that form. This can be complicated by requiring development of preparative methods that yield pure forms. How does one know when a sample is a pure polymorphic state unless it is limited to a single crystal? This process is further complicated by the fact that some analysis methods require sample preparation that can change the polymorphic form.

The conceptually more challenging aspect of this process is that there is no way to determine when all of the possible polymorphic forms have been obtained and used to obtain characteristic spectral, DSC or diffraction signals. The current state of the art in computational studies aimed at guiding this process indicate that there are usually many more energetically accessible polymorphic forms than have been detected. [Price, 2008, 2009]

The current state of the art in this field is described in a review by Park, 2007 and also in US Patent Application Publication No. 2002/0048610 A1. This published patent application provides a summary of the current state of the art namely high throughput screening using multiple solvents and solvent mixtures followed by analysis of each sample by some or all of the techniques noted above. This published patent application provides "separation" only in the form of using this method to find conditions that yield only the one desired result. It is possible that new polymorphic forms will be found using this method but there is no guarantee that all polymorphic forms will be found in this fashion. Probably more important in practice is that this method can not and will not detect the presence of minor polymorphic forms unless they have been previously seen and characterized.

Solution of the Problem

The invention provides systems and methods that will unambiguously permit the enumeration and characterization of polymorphic forms present in a crystallized API sample 'and in pharmaceutical preparations containing this API or of the polymorphic forms of two or more API's in formulations that contain multiple APIs.

Polymorphism, with extension to include solvates and salts as is consistent with use in the pharmaceutical industry, is defined as multiple crystal forms of the same chemical composition. However, a "pharmaceutical preparation" may contain more than one distinct chemical composition as distinct solid particles. Since it is useful to determine the polymorphic composition of the API in formulations with added ingredients, and because preparations purported to be pure API may contain impurities or decomposition products and further because there is a need to determine the composition of pharmaceutical preparations from uncertain sources, this more general term "pharmaceutical preparation" encompassing API mixed with other components will be used.

In one aspect, the invention features a method of mechanically separating a plurality of polymorphic forms of the API in a pharmaceutical preparation. The method comprises the steps of providing a fluid having a density gradient in a container situated in a gravitational field and having immersed therein a specimen comprising at least two particles of the API in a pharmaceutical preparation, the density gradient having a greater density at a lower extremity of the container in the gravitational field and a lesser density at a location above the lower extremity in the gravitational field; permitting the at least two particles of the API in a pharmaceutical preparation to attain respective stable positions with regard to the fluid having the density gradient in the container situated in the gravitational field; observing the respective stable positions with regard to the fluid having the density gradient in the container situated in the gravitational field attained by the at least two particles of the API in a pharmaceutical preparation; and determining whether respective particles of the specimen comprising the at least two particles of the API in a pharmaceutical preparation exhibit a plurality of densities. The method effects a mechanical separation of the specimen comprising the at least two particles of the API in a pharmaceutical preparation according to the respective densities of the at least two particles of the API.

In some embodiments, the container is a columnar container having a columnar volume aligned with the gravitational field. In some embodiments, the container comprises a microfluidic device having one or more columnar containers each having a columnar volume aligned with the gravitational field. In some embodiments, the fluid having a density gradient is introduced into the container and then the specimen comprising at least two particles of the API in a pharmaceutical preparation is immersed in the fluid having a density gradient. In some embodiments, the specimen comprising at least two particles of the API in a pharmaceutical preparation is introduced into the container and then the fluid having a density gradient is added. In some embodiments, the step of observing the respective stable positions with regard to the fluid having the density gradient in the container situated in the gravitational field attained by the at least two particles of the API in a pharmaceutical preparation comprises recording an image of at least one of the respective stable positions attained by the at least two particles.

In some embodiments, the method of mechanically separating a plurality of polymorphic forms of the API in a pharmaceutical preparation further comprises the step of measuring a density of the fluid at each of one or more selected positions with regard to the container situated in the gravitational field. This may involve the use of particulate density standards.

In some embodiments, the method of mechanically separating a plurality of polymorphic forms of the API in a pharmaceutical preparation further comprises the step of analyzing a quantity or a property of the particles of the API in a pharmaceutical preparation or of the fluid at each of one or more selected positions with regard to the container situated in the gravitational field. This may include the measurement of a spectrum of the material at several positions.

In some embodiments, the method of mechanically separating a plurality of polymorphic forms of a pharmaceutical preparation further comprises the step of extracting a selected portion of the contents of the container, the selected portion of the contents representing the contents of the container that, under quiescent and stable conditions, are situated between a first lower position in the gravitation field and a second higher position in the gravitational field.

In some embodiments, the fluid is a fluid selected from the group consisting of a mixture of organic fluids having different densities, a mixture of inorganic fluids having different densities, a fluid containing a dissolved substance that creates a density difference, and a combination of any of these fluids.

In another aspect, the invention relates to a method of continuously separating a plurality of polymorphic forms of a pharmaceutical preparation. The method comprises the steps of: providing a channel in a container situated in a gravitational field, the channel having an inlet defined in a lower extremity of the container, and having an exit aperture defined in the channel at a location above the inlet defined in the lower extremity of the container; placing in the channel a specimen comprising at least two particles of a pharmaceutical preparation; introducing at the inlet a fluid having a first density; increasing as a function of time a density of the fluid that is introduced at the inlet from the first density to a second greater density; and collecting at least one sample of fluid that exits the container by way of the exit aperture.

In some embodiments, the sample of fluid that exits the container by way of the exit aperture is monitored continuously as to a density of the fluid or some property related to the density of the fluid. In some embodiments, the sample of fluid that exits the container by way of the exit aperture is monitored to measure the nature or quantity of the materials entrained in the flow. In some embodiments, the fluid is monitored continuously. In some embodiments, the density of the fluid that is introduced at the inlet is increased up to a desired value and is then held constant for a period of time. In some embodiments, the period of time is a predetermined period of time. In some embodiments, the period of time is defined by a cessation of entrained particles in the fluid. In some embodiments, the cessation of entrained particles in the fluid is determined by examination of the contents of the fluid.

In yet another aspect, the invention features a particle separation apparatus configured to separate particles of a pharmaceutical preparation. The apparatus comprises a channel in a container situated in a gravitational field, the channel having an inlet defined in a lower extremity of the container, and having an exit aperture defined in the channel at a location above the inlet defined in the lower extremity of the container; a source of a fluid, the source of the fluid configured to provide fluid having a controlled density, the controlled density ranging as a function of time from a first density to a second higher density, the source of the fluid fluidly connected to the inlet defined in the lower extremity of the container; an aperture defined in the channel, the aperture configured to accept a quantity of material comprising particles of a pharmaceutical preparation to be separated; and a receptacle configured to receive at least one specimen of fluid that exits from the exit aperture defined in the channel.

In some embodiments, the particle separation apparatus further comprises a delivery tube connected to the exit aperture. In some embodiments, the source of the fluid comprises a controller configured to control at least one of a density and a flow rate of the fluid. In some embodiments, the apparatus is configured to be compatible with non-aqueous solvents. In some embodiments, the apparatus is configured to be compatible with halogenated solvents. In some embodiments, the container has a square or a circular cross-section. In some embodiments, the container is constructed from glass. In some embodiments, the container is constructed from plastic or metal tubes. In some embodiments, the container comprises a plurality of parallel channels.

In some embodiments, the particle separation apparatus further comprises an automated fraction collector that is configured to collect a sample of fixed or adjustable volume. In some embodiments, the automated sample collector is configured to direct the fluid that exits the exit aperture to a desired container.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

FIG. 3 is a schematic representation of a cassette density gradient array.

DETAILED DESCRIPTION

The invention provides a method of use of a density gradient to separate polymorphic forms of pharmaceutical materials on the basis of their density. The apparatus to be used in performing the methods of the present invention differs from that of U.S. Pat. No. 6,709,871.

The utility of this method stems from the discrete "quantized" nature of the density of crystals and from the fact that the particles in question are sufficiently large in volume that the buoyancy force drives them to equilibrium without need for centrifugation. It is a simple and inexpensive method to apply that provides an immediate visible result.

Figure 1:
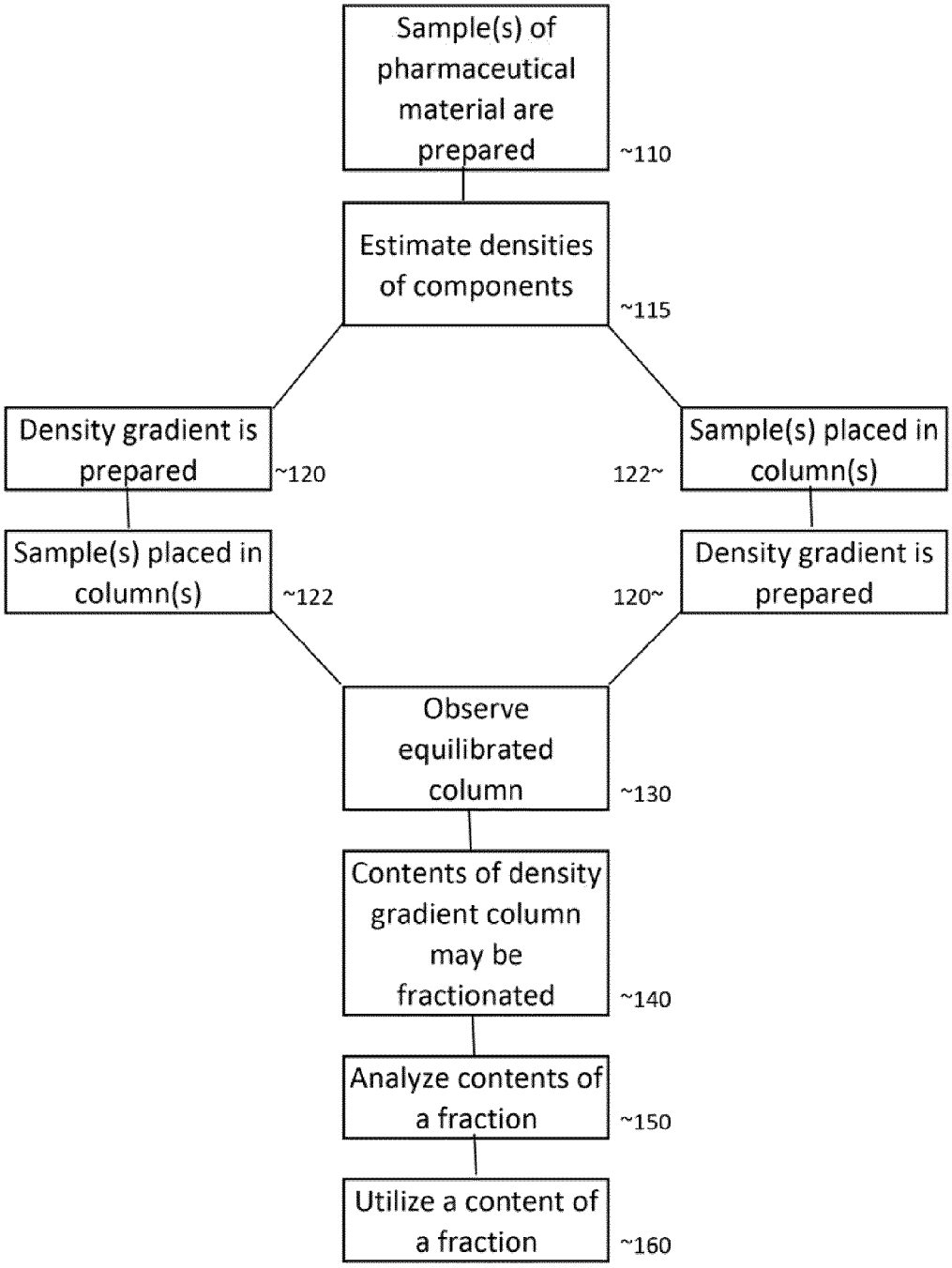
FIG. 1 is a flow diagram showing the overall scheme of the method.

A flow diagram for the method described here is shown in FIG. 1. As illustrated in FIG. 1, at step 110, labeled "Sample(s) of pharmaceutical material are prepared," a sample or samples of pharmaceutical materials are prepared or are received. Typically, for multiple samples, the samples will differ in the solvent from which they are grown or prepared. These multiple samples are then treated in an identical fashion.

As illustrated in FIG. 1, at step 115, labeled "Estimate densities of components," an estimate of the densities of the components or polymorphic forms of interest is made. The information used as input for this calculation may be, at a minimum, the elemental composition of the material. One can start with known data for the density estimate. For example, the density of a known morphological form of a known material may be used as an initial value, and may be obtained in some instances simply by looking such value up in a table.

As should be recognized, there need not be any temporal relationship between steps 110 and 115. Either step may be performed before the other, or they may be performed contemporaneously, possibly by two different actors working together.

As illustrated in FIG. 1, one can then perform two steps, in either order, as may be appropriate. In some embodiments, as shown on the left side of FIG. 1, step 120 is performed before step 122. In such an embodiment, a density gradient is prepared. This may be prepared in a single column or in multiple identical columns. Then in step 122, the samples of pharmaceutical material are applied to the density gradient columns.

Alternatively, as illustrated on the right side of FIG. 1, in step 122, the samples are placed in columns prior to the preparation of the density gradient. Then, in step 120, the density gradients are prepared in the columns containing the material.

As illustrated in FIG. 1, at step 130, labeled "Observe equilibrated column,"—one waits long enough to allow a column containing a density gradient and a material of interest to reach an equilibrium. One can then do any one or more of several actions. These include:

1. A photographic record is made of the column or columns. This may involve multiple sequential photographs. The photograph may include a position scale along the density gradient such as a ruler.
2. The column(s) may be treated by a method that provides qualitative information as to the nature of the material at each position along the density gradient and or quantitative information as to the density at each position along the density gradient.

3. The column(s) or photographs of the column(s) may be treated in such a way as to provide quantitative information as to the amounts of materials at each position along the density gradient.

These various actions can be performed sequentially or simultaneously, as may be convenient.

As illustrated in FIG. 1, at step 140, labeled "Contents of density gradient column may be fractionated," the contents of the density gradient column may be fractionated resulting in "density fractions" which may or may not contain visible material. In this process the density may be determined continuously or as each fraction is obtained.

As illustrated in FIG. 1, at step 150, labeled "Analyze contents of a fraction," one can perform one or more analytical processes. In some embodiments, the contents of each fraction may be determined quantitatively. In some embodiments, the contents of each fraction may be examined by spectroscopic or diffraction methods specific to polymorphic forms. In some embodiments, the contents of each fraction may be analyzed in a subsequent density gradient.

As illustrated in FIG. 1, at step 160, labeled "Utilize a content of a fraction," one can use the material present in a fraction of the fluid in a gradient density column. The contents of each fraction may be used as seed crystals for another preparation. This includes fractions that have no solid material visible by eye.

Figures 2A, 2B:
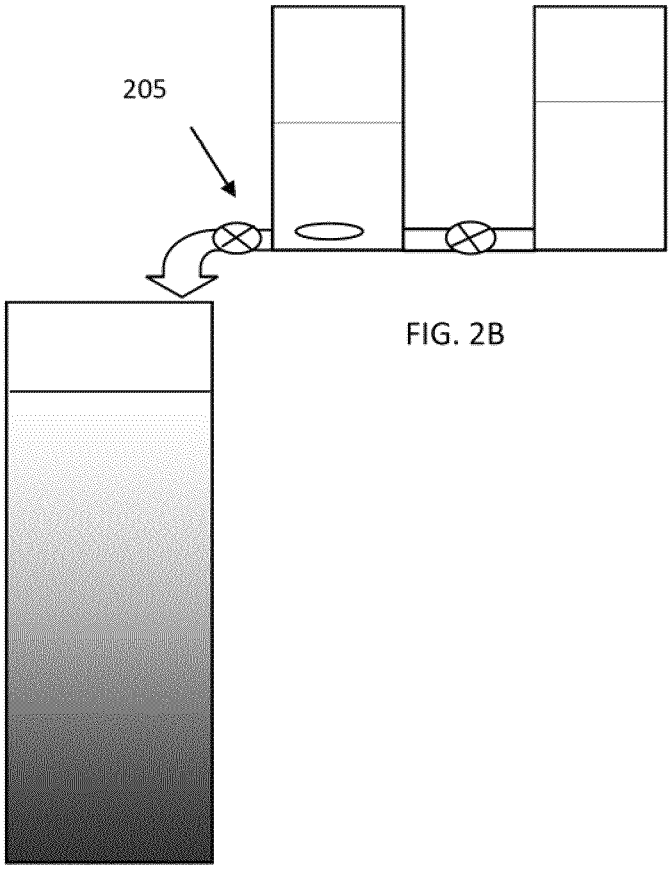
FIG. 2 is a schematic representation of a density gradient and the device used to form it.

A density gradient for the purpose of this method is prepared using two miscible liquids of known density (which may themselves be mixtures of liquids) using a device illustrated in FIG. 2B. The densities of the two liquids will become the upper and lower values of the gradient. A vertical tube is filled with a device that forms a continuous mixture of the two liquids. The result is a density gradient that is roughly linear.

FIG. 2A is a schematic illustration of a formed gradient. FIG. 2B is a schematic diagram of a gradient maker. In FIG. 2B the crossed circles 205 are stopcocks and the oval is intended to represent a magnetic stirrer bar.

Figure 2C:
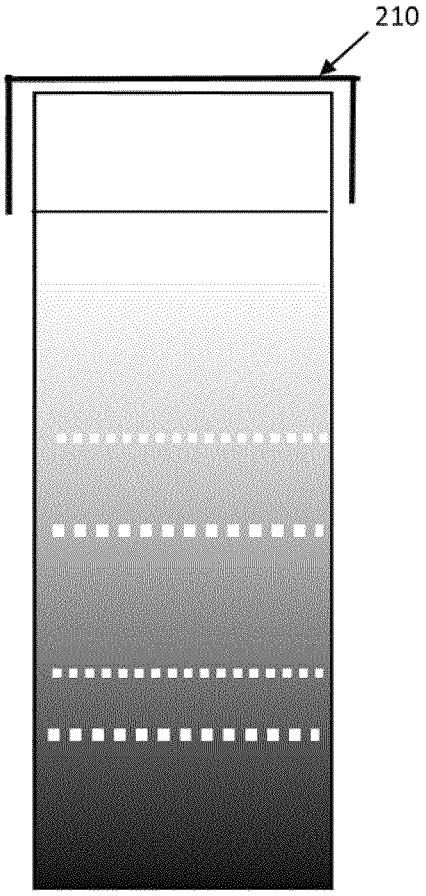

FIG. 2C is an illustrative schematic of a formed gradient with added pharmaceutical material containing at least four density forms. Each polymorphic form of the pharmaceutical material is represented by a respective one of the horizontal dashed white lines. All rectangles represent glass tubes. The thin solid horizontal lines are the meniscus for the liquid column in each case. The column can be covered after the API sample is added, for example with cover 210.

A sample of the preparation of pharmaceutical material is introduced to the column either at the upper (low density) end of the gradient or has been placed in the gradient tube prior to formation of the gradient in the tube. The material particles settle (or rise) in the gradient until each particle reaches its buoyant density at which point it remains stationary unless some process changes its density. Crystals of the same polymorphic form arrive at the same position because they have the same density which is distinct from that of other polymorphic forms. The appearance of the gradient remains roughly constant for days.

The presence of two or more materials with distinct densities in the preparation will result in distinct bands in the gradient. For an API for which several polymorphic forms are known from prior studies and for which single crystal x-ray diffraction studies have been performed, the position at which each known polymorphic form, solvate or salt is expected can be computed from the known density of the material as established by the results of single crystal diffraction analysis and the upper and lower density values or by use of density standards.

Bands at locations corresponding to densities differing from those of known polymorphs indicate new polymorphic forms which may be solvates or salts as discussed above. The regions of the gradient that may contain these new materials can be harvested even if the quantity of material in the gradient is not great enough to be visible to the naked eye. These may be used as seed crystals in crystallization.

Our method may be applied to a single preparation of pharmaceutical material, multiple samples prepared using the same method or multiple samples of pharmaceutical material prepared using different solvents, degrees of saturation, temperature or crystallization time or multiple samples with any other (perhaps unknown) history. This diagram of FIG. 1 and the exemplary embodiment presented below make clear that a key aspect of our method is that all samples prepared by either identical or differing conditions are then treated in an identical fashion in our method. A review of U.S. Pat. No. 6,965,832 indicates the absence of any method for physical separation of polymorphic species (and therefore the absence of the use of density differences for that undescribed separation) or any other reference to density except in background of the patent. The word or concept "density gradient" is not mentioned in U.S. Pat. No. 6,965,832. An important distinction between U.S. Pat. No. 6,965,832 and what is described herein is that U.S. Pat. No. 6,965,832 relies on the effects of differences in treatment of individual samples while our method treats all samples in an identical fashion. Our method is based on using the intrinsic property of density to produce separation.

DESCRIPTION OF AN EXEMPLARY EMBODIMENT

The invention described herein relates to a method of separation of the crystalline or polymorphic forms (or "components") of a preparation of pharmaceutical materials in solid form on the basis of the density of each crystalline or polymorphic form. This is an application, with some modifications, to the field of pharmaceutical process science of known density gradient technology from the field of cell biology, polymer science and glass science. [Bornstein & Steberl, 1959; Kind & Summerscales, 1966; US 2004/6,709,871 B2; Richards, 1999; ASTM D 1505-98; ISO 1183-2:2004; Yanagi, 2010; Doom, 2010; Chemov, 2009a.b; Moshammer, 2009; Fleurier, 2009; Kato, 2009; Deng, 2008, 2009; Park, 2008; Lu, 2006; Hersam, 2006] In applications of this method in the field of pharmaceutical preparations the method does not involve the use of an ultracentrifuge. The method may be used to determine the presence and the amount of each species of discrete density in the sample, the mean densities of each crystalline or polymorphic form, to fractionate the sample into forms of pure density including the preparation of materials to be used as seed crystals for further growth of materials and to observe changes in the density of pharmaceutical materials that occur spontaneously or due to interaction with crystalline or polymorphic forms of the density gradient. This last feature is unique to the application of this method applied to polymorphic crystal forms. A schematic view of the invention is shown in FIG. 2 and FIG. 3.

We illustrate the application of this method of separation with the case of the polymorphic forms of sulfathiazole. Sulfathiazole has been extensively studied as an example of "pharmaceutical polymorphism" [Baker et al., 2009; Picker-Freyer, 2007; Blagden et al., 1998; Chan et al., 1999; Parmar et al., 2007]

Sulfathiazole has five known polymorphic forms. The data in the literature for sulfathiazole are somewhat contradictory as to the methods of preparation of pure forms. Emphasis has been placed on the effect of change of solvent as a means for obtaining specific forms.

The densities of the five polymorphic forms of sulfathiazole are given in order of increasing density in Table 1, as set forth below.

TABLE 1

Densities of suolfathiazole polymorphic forms.

| form | density |
|---|---|
| V | 1.484 |
| I | 1.500 |
| II | 1.551 |
| III | 1.569 |
| IV | 1.595 |

These results for forms I-IV are from single crystal x-ray results. [Blagden, 1998] For form V the result given is from a synchrotron x-ray powder diffraction study. [Chan, 1999] The basis of this Method of Separation is that crystalline API polymorphic forms can be separated because they differ in their density. This separation can be accomplished using a preformed density gradient that spans the range 1.45 to 1.65 g/cm$^3$.

Density Gradient Preparation

Our density gradient methodology is a refinement and extension to the pharmaceutical industry of existing well-established methodologies in other fields. [Bomstein & Steberl, 1959; Kind & Summerscales, 1966; US 2004/6,709,871 B2; Richards, 1999; ASTM D 1505-98; ISO 1183-2:2004; Yanagi, 2010; Doom, 2010; Chernov, 2009a.b; Moshammer, 2009; Fleurier, 2009; Kato, 2009; Deng, 2008, 2009; Park, 2008; Lu, 2006; Hersam, 2006]. A density gradient is made with a "gradient maker" consisting of two chambers connected through a stopcock and with a second stopcock on one of the containers to an outflow tube. A mixer is used in the outflow chamber.

We have developed this technique to optimize reliability and visibility of the resulting separated materials. In particular, we have created a device that permits the formation of identical gradients in one overall unobstructed container (see FIG. 3 and FIG. 4). These columns are at the outer wall of the overall cylindrical container. A central black column permits viewing of the materials in each column individually. The tubes that will contain the samples of crystalline material are open at the bottom; the gradient maker fills all columns simultaneously forming identical gradients.

A density gradient was prepared in the device described above using a mixture of benzene and chloroform ($\rho$=1.32 g/cm$^3$) as one liquid and tetrachloroethylene ($\rho$=1.62 g/cm$^3$) as the other.

Previous work [Parmar, 2007] indicates that sulfathiazole crystallized from water or ethanol, methanol, isopropanol and n-butanol or n-propanol should result in forms IV, II, III and I, respectively. Fresh crystalline samples of solid sulfathiazole were prepared by crystallizing about 50 mg of sulfathiazole (Sigma-Aldrich lot 028K1522) from water, methanol, ethanol, isopropanol and n-butanol by dissolving them at about 55° C. and then cooling to ambient temperature to form crystals at which point material was harvested. All materials were made at the same time, isolated within an hour of each other and dried with a stream of argon gas.

Based on the density gradient analysis, this rapid crystallization gives from water a mixture of forms III and IV in about equal amount, from both methanol and ethanol form II and III, from isopropanol a mixture of forms I, II and III and from n-butanol form I. The bands for this last material are distinctly more compact than those of the other forms. There is no evidence of form V. The results are summarized in Table 2, as set forth below.

TABLE 2

Analysis of fresh samples of quickly crystallized samples of sulfathiazole.

| | | Form I | Form II | Form III | Form IV | Expected [23] |
|---|---|---|---|---|---|---|
| Tube A | Water | ND | minor | major | major | Form IV |
| Tube B | MeOH | ND | major | major | minor | Form II |
| Tube C | EtOH | ND | major | major | minor | Form IV |
| Tube D | iPrOH | very minor | major | minor | very minor | Form III |
| Tube E | nBuOH | major | ND | ND | ND | Form I |

Seeding Satureated Solutions (Amplifying Forms)

Parmar, 2007 states that crystallization from n-propanol yields form I and that that form is stable in this solvent. In a seeding experiment we harvested material that was the right density for form III and used this to seed crystallization in n-propanol. The resulting crystals, slowly grown at ambient temperature, are not consistent with form I or form III, but are consistent with form II. The density by a flotation density test indicates this material to be form II. The observation that form II is obtained in this case is quite probably due to the presence of a small amount of form II in the predominantly form III sample. The novel nature of this result is emphasized by comparison with a recent publication [Bakar, 2009] that claims that seeding sulfathiazole crystallization in n-propanol with form II or form III seeds does not result in growth of those seeds. That is not the case with our seed crystals.

Modifications & Extensions of the Method Relevant to the Field

For application of the density gradient method to pharmaceutical process science some modifications of the methods used in other fields may be preferred. These relate in most cases to the finite and sometimes rather large size of the particulates and to interaction of the API with the solvent.

Small particles of known density can be added to the column to provide density standards. Alternatively, the refractive index of the gradient can be measured as a function of position and this can be used to establish the density via a calibration procedure.

The presence of particulate matter in the gradient in large amounts may perturb the gradient. This can be corrected for using the above calibration procedures. This phenomenon should not affect the qualitative or semi-quantitative use of the gradient.

Gradient Resolution and Stability

The contents of each chamber of the gradient maker can be adjusted to similar density values to adjust the steepness of the gradient to improve separation. This steepness can also be adjusted with constant limiting values by using a longer, smaller diameter container for the gradient. The usual gradients are found to be stable for days. For precision studies temperature control can be added as needed.

Fractionation Methods

Due to large and variable particulate size, the preferred embodiment of a method of fractionation is to remove material at the top by allowing heavy liquid to enter the bottom of the gradient. The lighter liquid cascades into a receiving tube affixed at the top of the gradient column with about a 45 degree downward angle. The heavy liquid flow is controlled by the height of an adjacent heavy liquid reservoir via a flexible connecting line. In cases where crystals are stuck in the angular down tube, these are rinsed forward with low density liquid We note that the above consideration leads directly to a dynamic density gradient fractionation method depicted in FIG. 5. In this embodiment the contents of the gradient maker are reversed so that the low density liquid enters the fractionation chamber first. A sample of the API to be fractionated is first placed on a frit at the bottom of the fractionation chamber which is a short column with an outflow tube. The initial low density liquid causes the lowest density component or crystalline form of the API sample to be the first to arrive at the fraction collector that receives samples from the outflow tube. More dense samples arrive at the collector last. It may be necessary to mix the API sample by stirring to permit release of the less dense components or crystalline forms. The sample collector may be fitted with filtration capability including suction permitting rapid drying of the fractionated material. We cite U.S. Pat. No. 3,862,029 as reference to an embodiment of this concept.

Liquids for Formation of Density Gradients

The exemplary embodiment uses organic liquids, often chlorinated solvents. Alternatively perfluorinated hydrocarbons, ketones and segregated hydrofluoro ethers (3M's Fluorinert™ and Novec™) may be of interest. Fluorinert™ is a family of liquids with a density that ranges from 1.63 to 1.94 g/cm$^3$. The Novec™ materials family includes segregated ethers with densities as low as 1.4 g/cm$^3$). These materials have been engineered to be environmentally friendly and inert to chemical interactions with other materials. New liquids may be designed in the future driven by the need generated in this new area for pharmaceutical discovery, development and manufacture.

Aqueous Gradient Materials

Aqueous solutions may offer advantages in terms of safety, cost, low environmental impact and use in large scale preparation to obtain polymorphic purity. In either case the two solutions used in the gradient maker chambers may themselves be mixtures. Thus, low and high concentration salt solutions may be used. Iodinated x-ray contrast reagents or related materials that are used for density gradient formation are commercially available for this purpose. [Axis-Shield, Oslo, Norway]. The maximum density of these materials is 1.4 g/cm$^3$.

An alternative method of separation by density based on a magnetic field gradient has been described. [Mirica, 2009; Phillips, 2009; Mirica, 2008; Shevkoplyas, 2007; Winldeman, 2007]. This method does not involve a density gradient.

Determination of Properties of Column Contents

Raman spectroscopy can be applied directly to these gradient columns to confirm the nature of the contents. This may prove particularly useful when the sample has components that are not the API such as excipients. For this purpose it may prove useful to use square cross section columns. A Raman spectrometer popular in pharmaceutical use uses a fiber optic probe for both excitation and signal collection and has a large diameter beam and a long working distance on the order of 5 cm.

Semi-Quantitative Determination of Column Contents

One of the major benefits of the gradient method is that it provides an immediate visual report of the number of materials in an API preparation. A qualitative interpretation of the relative amounts of components in the gradient is easily made. An example is given with the Exemplary Embodiment in Table 2 based on the results shown in FIG. 4. A more quantitative estimate could be obtained by a simple light scattering analysis with simple added apparatus that performs either transmission or 90 degree scattering measurements. Calibration of the light scattering signal as a function of the amount of API could be performed using a sample in a very steep gradient (and thus not separated). This would make this a semi-quantitative method.

Time Dependent Changes in the Contents of the Gradient

We have observed time-dependent changes in the position of the particles in these gradients. One of the more obvious of these is the initial sedimentation of the larger particles to their final position at a faster rate than the smaller particles. This could be made into a method for determination of the particle sizes of each density component. Web cam methods of recording permit later analysis.

Changes in the positions of particles after initial equilibration in the gradient indicate changes in density of the suspended particles. This could be due to changes in polymorphic form in either the strict sense or due to desolvation of a solvated form. The observation of such changes as a function of the composition of the gradient material might prove to be a very efficient way to develop methods for polymorph conversion. Low levels of added components such as water uniformly distributed throughout the gradient might lead to acceleration of this conversion process. The ability to observe these changes in real time is unique to this method.

Figure 4:
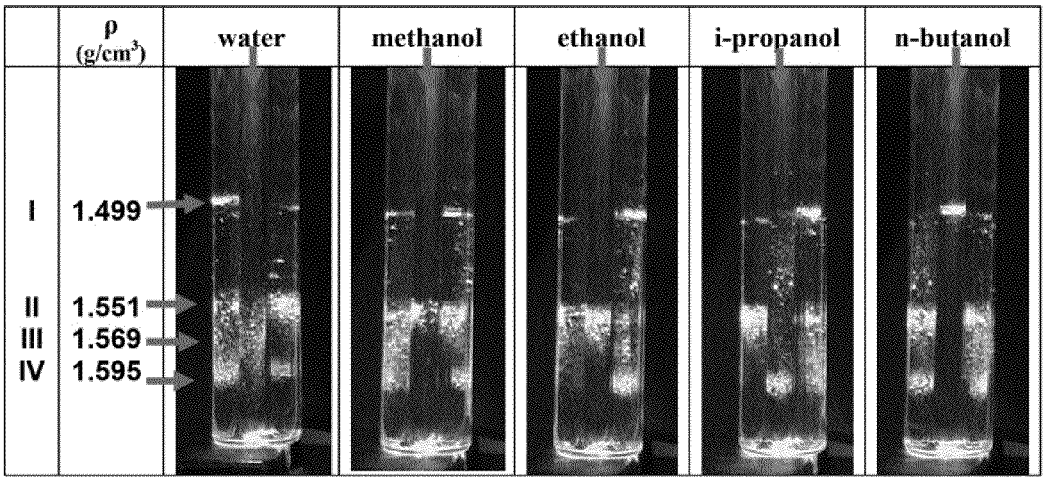
FIG. 4 illustrates a polymorph analysis in a density gradient cassette showing results for the API sulfathiazole.

FIG. 4 is a diagram that illustrates a polymorph analysis in a density gradient cassette. The label at the top of each column refers to the solvent used to crystallized the material in the column in the front middle. What is seen to either side of the central column is the superposition of the two flanking tubes in the array. The central position of the array is occupied by a carbon rod so the back middle tube is blocked and the front middle tube has a black background.

Figure 5:
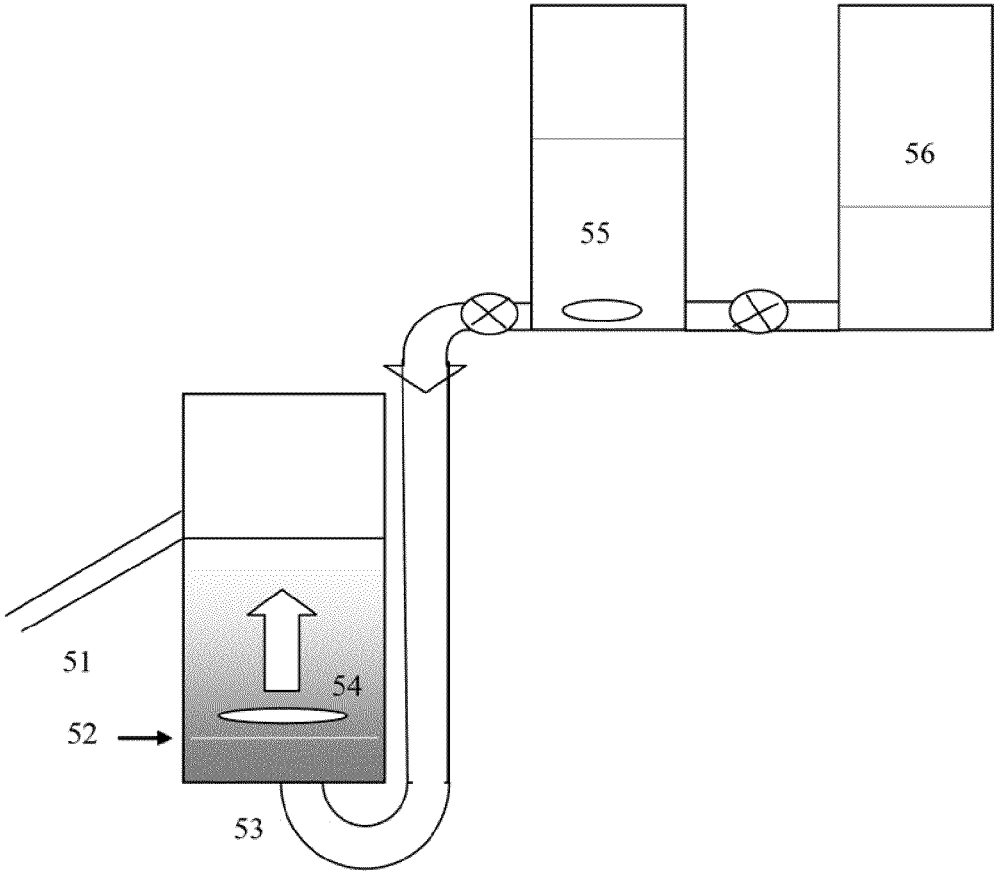
FIG. 5 is a schematic representation of a dynamic gradient API fractionation device.

FIG. 5 is a schematic diagram of a dynamic density gradient fractionation device. A short column has an angled out-flow collection tube (51), a glass fit near the bottom (52) and an inlet port at the bottom (53). The inlet port may be at the side of the tube below the frit. A sample of the API to be fractionated (not shown) is placed on the frit. A stir bar (54) is indicated to facilitate release of the less dense components of the API sample. For large samples this would be replaced by a shaft-driven stirrer. The fractionation column can be covered as indicated.

A gradient maker at the upper right has a less dense liquid in its proximal stirred out-flow chamber (55) and a more dense liquid in its distal chamber (56). The liquid delivered to the fractionation chamber increases in density as time proceeds and thus the least dense components of the API sample are removed first to a sample collector (not shown) placed below the out-flow tube (51) in order of increasing density. The arrows indicate the direction of liquid flow.

Definitions

For the purposes of this application the term "Pharmaceutical Material" is defined to include known API's whether crystalline (including solvates and hydrates) or amorphous, all materials in test as potential API's and all materials used are precursors or in the synthesis of potential or actual API's.

For the purposes of this application, the term "pharmaceutical preparation" is defined to mean a mixture of solid forms of differing composition of which one (and perhaps the only) component is a pharmaceutical API of defined composition (here including hydrates. solvates and salts of the API in question) and not to mean that the practitioner of the described methods has to know a given overall chemical composition of a specific sample that may be processed using the systems and methods of the present disclosure. The other components of the mixture of solid forms comprising a "pharmaceutical preparation" may be materials added during formulation stages. These other materials will most commonly be known as to composition but their amounts may not be known. Their composition at the molecular level will be distinct from that of the API. The invention also contemplates the situation in which only one form of the API is present, in which case only one fraction or stratum of the gradient density will contain the API.

Areas of Utility

We here outline the multiple areas of applicability of this method as applied in pharmaceutical process science. These are presented roughly in the order of API development.

This method will be invaluable in early-stage search for polymorphic forms. The main advantage of the method is that it makes no preconceptions as to what will be observed. What you see is what there is. High throughput screens for polymorphic forms that involve examination of multiple solvents usually also involve isolated solid forms for use in Raman and power x-ray studies. These could be adapted to include density gradient analysis in multiple identical gradients as indicated in the Exemplary Embodiment. Further, implementation of the use of light scattering methods described above could be used to automatically detect cases needing further attention.

Density gradient separation can be used as an aid in calibration of other analytical methods by providing polymorphically pure samples for obtaining XRPD or spectral signals and by testing the results of analysis of spectra of composite samples.

A particularly advantageous use of this method in early stage searches of polymorphic forms relates to the fact that polymorphism is a kinetic phenomenon. In the usual search of polymorphic forms, including high-throughput screening methods, what is being observed is the effect of crystallization solvent and conditions on the relative rates of nucleation of polymorphic forms. For example, in the case of n-propanol the nucleation of forms more stable than form I is strongly retarded. Density gradient analysis of the results of a prior crystallization permits the use of fractions of the resulting gradient as seeding material in a subsequent crystallization. If all fractions of a gradient are used this will include regions where nothing is seen but which contain low levels of nuclei of polymorphic forms that, in the original crystallization, were prevented from enlarging. The main point is that known forms will be selectively excluded in the subsequent cycle.

Monitoring the outcome of batch or continuous crystallizations in API bulk production permits easy optimization of the crystallization process. This may be used for monitoring purposes or as an off-line density selection step that permits use of seeds in subsequent crystallization that are limited to the appropriate form.

Monitoring the outcome of formulation API is aided by density separation measurements at each step in the formulation process including post formulation.

Post formulation the density gradient separation method can be used to monitor changes in the polymorphic form of the API. Further the possibility that an API exists in a distribution of polymorphic forms becomes manageable as changes in that distribution can be monitored.

The density gradient separation method may be used to monitor the solid-state density distribution of API throughout the supply chain. The distribution of polymorphic forms may be used as an index of quality.

All patents and references cited herein are explicitly incorporated by reference in their entirety.

Although the present method has been described with reference to a certain embodiment, other embodiments are possible. Therefore, the spirit and scope of the appended claim should not be limited to the description of the preferred embodiment contained herein. Modifications and variations will be apparent to those skilled in the art from the foregoing description and such modifications and variations are intended to come within the scope of the appended claims.

What is claimed is:

1. A method of mechanically separating a plurality of polymorphic crystal forms of the API component of a pharmaceutical preparation, comprising the steps of:

providing a fluid, wherein said fluid comprises at least two non-aqueous solvents having different densities, having a density gradient in a container situated in the earth's gravitational field and having immersed therein a specimen comprising at least two particles wherein each of said at least two particles comprises a polymorphic crystal form of an API component of a pharmaceutical preparation, said density gradient having a greater density at a lower extremity of said container in said gravitational field and a lesser density at a location above said lower extremity in said gravitational field;

permitting said at least two particles of said API component of said pharmaceutical preparation to attain respective stable positions with regard to said fluid having said density gradient in said container situated in said gravitational field;

observing said respective stable positions with regard to said fluid having said density gradient in said container situated in said gravitational field attained by said at least two particles of said API component of said pharmaceutical preparation; and determining whether respective particles of said specimen comprising said at least two particles of said API component of said pharmaceutical preparation exhibit a plurality of densities;

thereby effecting a mechanical separation of said specimen comprising said at least two particles of said API component of said pharmaceutical preparation according to the respective densities of said at least two particles of said API component.

2. The method of mechanically separating a plurality of polymorphic forms of the API component a pharmaceutical preparation of claim 1, wherein said container is a columnar container having a columnar volume aligned with said gravitational field.

3. The method of mechanically separating a plurality of polymorphic forms of the API component of a pharmaceutical preparation of claim 1, wherein said container comprises a microfluidic device having one or more columnar containers each having a columnar volume aligned with said gravitational field.

4. The method of mechanically separating a plurality of polymorphic forms of the API component of a pharmaceutical preparation of claim 1, wherein said fluid having a density gradient is introduced into said container and then said specimen comprising at least two particles of said API component of said pharmaceutical preparation is immersed in said fluid having a density gradient.

5. The method of mechanically separating a plurality of polymorphic forms of the API component of a pharmaceutical preparation of claim 1, wherein said specimen comprising at least two particles of said API component of said pharmaceutical preparation is introduced into said container and then said fluid having a density gradient is added.

6. The method of mechanically separating a plurality of polymorphic forms of the API component of a pharmaceutical preparation of claim 1, wherein said step of observing said respective stable positions with regard to said fluid having said density gradient in said container situated in said gravitational field attained by said at least two particles of said API component of said pharmaceutical preparation comprises recording an image of at least one of said respective stable positions attained by said at least two particles.

7. The method of mechanically separating a plurality of polymorphic forms of the API component of a pharmaceutical preparation of claim 1, further comprising the step of measuring a density of said fluid at each of one or more selected positions with regard to said container situated in said gravitational field.

8. The method of mechanically separating a plurality of polymorphic forms of the API component of a pharmaceutical preparation of claim 1, further comprising the step of analyzing a quantity or a property of said particles of said API component of said pharmaceutical preparation or of said fluid at each of one or more selected positions with regard to said container situated in said gravitational field.

9. The method of mechanically separating a plurality of polymorphic forms of the API component of a pharmaceutical preparation of claim 1, further comprising the step of extracting a selected portion of the contents of said container, said selected portion of the contents representing the contents of said container that, under quiescent and stable conditions, are situated between a first lower position in said gravitation field and a second higher position in said gravitational field.

* * * * *